US008562054B2

(12) United States Patent
Keller

(10) Patent No.: US 8,562,054 B2
(45) Date of Patent: Oct. 22, 2013

(54) TRAINING CHOPSTICKS

(76) Inventor: Robin O. Keller, Lincoln, CA (US)

( * ) Notice: Subject to any disclaimer, the term of this patent is extended or adjusted under 35 U.S.C. 154(b) by 0 days.

(21) Appl. No.: 13/134,242

(22) Filed: Jun. 1, 2011

(65) Prior Publication Data

US 2011/0298236 A1 Dec. 8, 2011

Related U.S. Application Data

(60) Provisional application No. 61/396,813, filed on Jun. 2, 2010.

(51) Int. Cl.
*A47G 2/10* (2006.01)

(52) U.S. Cl.
USPC ..... 294/218; 294/99.2

(58) Field of Classification Search
USPC ..... 294/218, 99.2
See application file for complete search history.

(56) References Cited

U.S. PATENT DOCUMENTS

| | | | | | |
|---|---|---|---|---|---|
| 581,810 | A * | 5/1897 | Clarkson | 294/99.2 |
| 964,526 | A * | 7/1910 | Knapp | 294/99.2 |
| 2,997,328 | A | 8/1961 | Lee | |
| 3,465,621 | A * | 9/1969 | Ladd | 294/99.2 |
| 3,637,248 | A | 1/1972 | Arita | |
| 3,884,456 | A * | 5/1975 | Lew | 267/156 |
| 3,889,995 | A * | 6/1975 | Lin | 294/99.2 |
| 3,937,510 | A | 2/1976 | Lew | |
| 4,312,530 | A | 1/1982 | Young | |
| 4,973,095 | A | 11/1990 | Kunihisa | |
| D445,312 | S * | 7/2001 | Shulman | D7/642 |
| 7,234,745 | B1 * | 6/2007 | Tsai | 294/99.2 |
| 2009/0165307 | A1 * | 7/2009 | Lam et al. | 30/123 |

FOREIGN PATENT DOCUMENTS

| | | |
|---|---|---|
| FR | 2704408 | * 11/1994 |
| JP | 2001-269257 | * 10/2001 |
| JP | 2009-273839 | * 11/2009 |
| WO | WO 2005/099527 | * 10/2005 |

* cited by examiner

*Primary Examiner* — Dean Kramer
(74) *Attorney, Agent, or Firm* — Heisler & Associates

(57) ABSTRACT

Chopsticks are provided including a first chopstick and a second chopstick which have been modified to be readily coupled together. Bores are formed in each of the chopsticks. A pin is supplied which passes through each of the bores. The pin has a friction fit within the bores such that the chopsticks are held together. The pin resiliently flexes when distal ends of the chopsticks are brought together, so that the pin provides a return force to the chopsticks. The bores and pin preferably have a non-circular cross-section so that the chopsticks are held within a common plane. The pin can have at least one tip that is pointed so that the pin can double as a toothpick.

11 Claims, 3 Drawing Sheets

D
20
21
23
26
42
40
A
31
36
33
30
7
44
10

120
126
142
140
A
130
136
9
144
110

220
226
242
240
A
230
236
11
244
210

E
J
G
I
F
E
40

240

140

TRAINING CHOPSTICKS

CROSS-REFERENCE TO RELATED APPLICATIONS

This application claims benefit under Title 35, United States Code §119(e) of U.S. Provisional Application No. 61/396,813 filed on Jun. 2, 2010.

FIELD OF THE INVENTION

The following invention relates to chopsticks for use as utensils in eating food, and for gripping and lifting other small items. More particularly, this invention relates to chopsticks which have been fashioned to hold the chopsticks together and make the chopsticks easier to use.

BACKGROUND OF THE INVENTION

Chopsticks are known eating utensils which are generally elongate rigid structures typically approximately ten inches long and about ¼ inch wide. Typically, one end of the chopsticks will taper to a smaller form, such as ⅛ inch, at distal tips thereof. Chopsticks can be generally round in cross-section, but often have a somewhat distinct from perfectly round contour or even a square or rectangular contour, such that the chopsticks do not tend to roll too easily when held in the hand of a user or placed on a sloping surface.

Once mastered, chopsticks can be effectively used as eating utensils by being held in a single hand of a user between a thumb and fingers thereof. However, when one is using chopsticks for the first time, the process of learning to use the chopsticks can be rather difficult. Due to this difficulty, chopsticks are not as widely used as they otherwise would be.

Chopsticks have many advantages over other eating utensils. They are exceptionally simple and thus have a low cost to manufacture. They can work very effectively when made out of renewable and/or biodegradable materials, such as wood. Thus, the opportunity is presented to utilize disposable eating utensils with almost no effect on the environment, and save the effort and environmental impacts associated with washing reusable utensils. Furthermore, chopsticks usage can be an enjoyable practice and can enhance the eating experience, especially when enjoying Asian cuisine.

Numerous attempts have been made to modify chopsticks or add structures which hold the two chopsticks together to function as a training tool to assist those with little experience in using chopsticks in the proper utilization of chopsticks. These various devices have various degrees of complexity and various degrees of usefulness. What appears to be lacking in this study of prior art chopsticks training devices is to capture both exceptionally low cost while maintaining a high level of desired function. Rather, prior art devices generally involve a trade off between cost/complexity and effectiveness. When disposable chopsticks are being used, especially, the cost of training chopsticks benefits from being exceptionally low so that no financial burden is provided on those who choose to utilize the training chopsticks. Also, it is desirable for a single chopstick package to be utilizable either in a training mode or by experienced users without complicating the usage process for the experienced user and while providing a simple and effective assembly for those who desire to utilize the chopsticks in a training mode.

SUMMARY OF THE INVENTION

With this invention chopsticks are provided which have been slightly modified to be usable in a training configuration.

In particular, the two chopsticks are preferably substantially identical and elongate in form similar to prior art chopsticks. One distinction is that a small bore is formed within each of the chopsticks. This bore has a diameter of approximately half of a thickness of the chopsticks and extends perpendicular to a long axis of the chopsticks. If the chopsticks have a cross-section which is wider than it is tall, this bore would pass along the wider dimension of the cross-section of the chopsticks in a most preferred embodiment. The bores are preferably formed approximately sixty percent of the distance away from the more pointed distal ends of the chopsticks which are configured for grasping food, as shown in the included figures.

An elongate pin is provided which is sized to fit through each of the bores in the chopsticks. This pin preferably has slightly tapered ends to facilitate alignment with the bores in the chopsticks. A diameter of the pin is such that it has a friction fit within the bores in the chopsticks. This pin has a cross-section shaped to match the shape of the bores passing through the chopsticks.

The pin is passed through each of the bores in the chopsticks. A spacing of the chopsticks can vary based on the desires of the user, but would typically involve a spacing which is slightly more than half of an overall length of the pin. The pin is preferably made of wood, but could be made of other materials. Importantly, the pin is formed of a material which can bend slightly but which resists such bending somewhat. Hence, the pin tends to keep the two chopsticks parallel when at rest. However, when forces are applied tending to cause distal ends of the chopsticks to be brought together, the pin is bent slightly. The pin then exerts a return force on the chopsticks tending to return the chopsticks to their spaced configuration when this closing force is released.

One material which has been shown to be effective for forming the pin is bamboo wood. Other woods and other materials having suitable strength and elasticity characteristics could similarly be utilized.

In a preferred form, this invention is originally provided in a simple package where the two chopsticks are initially not yet totally separated from each other. Rather, they have been machined to be largely separated and with a score line running in an elongate direction between the two chopsticks. The user breaks the two chopsticks apart before use along this score line. In such a package, the pin can be set within this score line groove. A small amount of food grade adhesive, such as a cornstarch based adhesive can be utilized to temporarily bond the pin to the chopsticks. They can then fit together within a paper sleeve as is commonly provided for disposable chopsticks storage. Note that if the chopsticks have a cross-section that is wider than it is tall, the bores are aligned so that a single bore forming step can form the bores in each chopstick. As an alternative, two separate holes can be made for each chopstick.

When a user wishes to utilize the chopsticks, they are first broken apart. Next, the pin is removed from whichever chopstick the pin may have remained attached to. Finally, the pin is routed through the bores until a desired spacing for the chopsticks is achieved. The training chopsticks are then ready for use. If the user does not need the training aspect of the chopsticks, the pin is merely discarded. By initially forming the chopsticks together, one benefit is that the holes passing through the chopsticks can repeatedly be consistently formed at precisely the same location on each chopstick. In particular, a common drilling tool would drill both bores simultaneously when the two chopsticks are still held together within a single original piece of wood.

In a further alternative of the invention, the pin can be more pointed at one end or both ends and double as a toothpick. In such an embodiment the benefit of both training chopsticks and a toothpick are all provided together in a single exceptionally simple disposable package and biodegradable.

As another alternative, rather than gluing the dowel to the chopsticks, the pin could be floating freely within the same package, or could be formed along with the chopsticks but not entirely separated from the chopsticks so that the pin needs to be broken off from the chopsticks before being utilized. In such an embodiment the pin would be formed of a common piece of wood as the chopsticks. While this could be the case, most typically the disposable chopsticks themselves are formed of a different wood than that of the pin so that the least expensive wood can be used for the chopsticks and a wood having optimal performance characteristics is supplied for the pin.

By making both the chopsticks and the pin all of wood, the entire assembly is both recyclable and biodegradable. In particular, the entire assembly could be recycled such as by incineration or allowing natural decomposition within a landfill. Biodegradability could occur within a landfill with nothing about the training chopsticks product deviating from typical compostability criteria and other biodegradability standards. To optimize such a recyclable and biodegradable configuration for the invention, the chopsticks themselves would be provided free of any unnatural finishes and any adhesive utilized to temporarily bond the pin to the chopsticks before use would be either a food grade adhesive or at a minimum some adhesive which exhibits biodegradability and recyclability.

Any inks provided on the chopsticks as well as packaging for the chopsticks would also benefit from meeting biodegradability and compostability standards, such as by utilizing recyclable paper for the packaging and biodegradable inks thereon. This packaging can additionally include a series of illustrations which show the steps in assembling the training chopsticks so that those unfamiliar with the product can readily discern how to assemble the training chopsticks from their initial stored mode to their final mode ready for use.

In another embodiment, the pin can be formed non-circular, such as with an oval or elliptical cross-section. The bores passing through the chopsticks can be formed with a similar oval form, such as by having a drill bit first pass through the chopsticks and then having the chopsticks moved laterally slightly to make the hole oblong in each chopstick. A drill bit can be particularly utilized which is capable of such a milling procedure somewhat to facilitate the making of such an oblong or elliptical bore. In such a configuration, the pin would have a cross-section matching (or at least complementary with) the cross-section of the bore, but the bore would be non-circular. Such an arrangement would restrain the chopsticks from pivoting about a long axis of the pin and further enhance the effectiveness of the training chopsticks in that the distal ends of the chopsticks would tend to remain within a common plane for consistent repeatable motion touching each other when acted upon by the user.

OBJECTS OF THE INVENTION

Accordingly, a primary object of the present invention is to provide chopsticks which are easier to use, for training purposes or merely to simplify the chopsticks use experience.

Another object of the present invention is to provide a pair of chopsticks which are configured to keep the chopsticks within a common plane and avoid becoming skewed relative to each other.

Another object of the present invention is to provide a chopsticks assembly in which two chopsticks are held together, flex relative to each other and still are formed entirely from biodegradable materials.

Another object of the present invention is to provide a pair of chopsticks which are held together and which are exceedingly simple to manufacture in a reliable and low-cost fashion.

Another object of the present invention is to provide a method for forming and packaging chopsticks so that they can be configured to be held together when in use.

Another object of the present invention is to provide a chopsticks assembly which both holds the pair of chopsticks together and also provides a toothpick as part of the overall assembly.

Other further objects of the present invention will become apparent from a careful reading of the included drawing figures, the claims and detailed description of the invention.

DESCRIPTION OF THE PREFERRED EMBODIMENT

Figure 4:
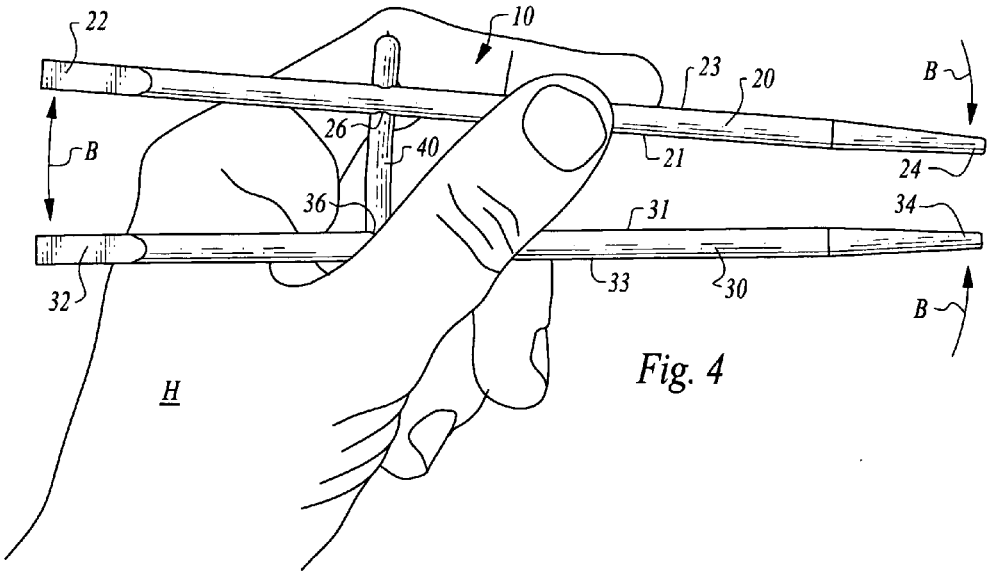
FIG. 4 is a front elevation view of the chopsticks assembly of FIG. 1 shown being held within a hand of a user in an operable position and just after the beginning of a closing procedure for closing distal ends of the chopsticks together.
Figure 5:
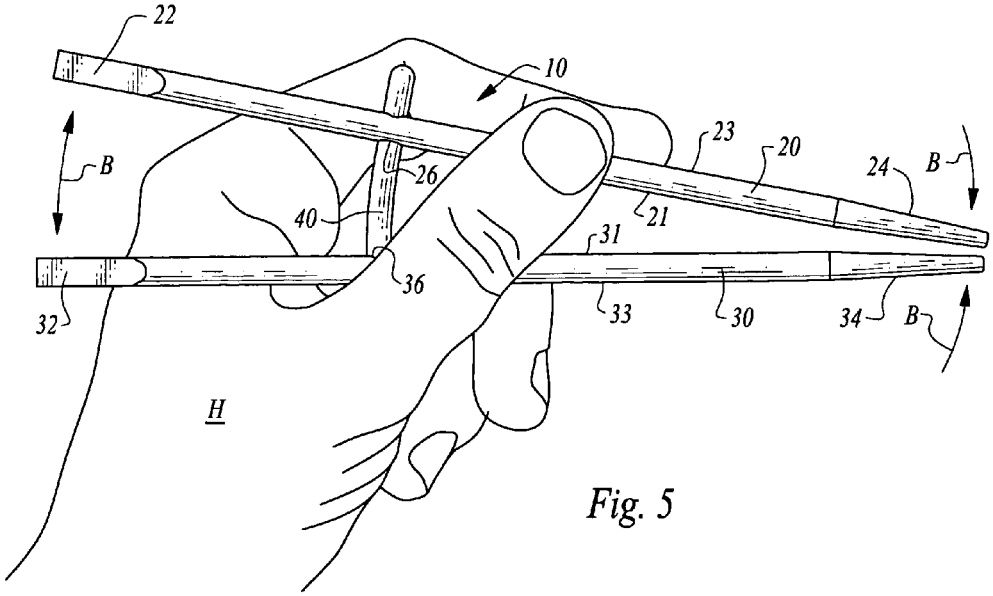
FIG. 5 is a front elevation view similar to that which is shown in FIG. 4 but after the distal ends of the chopsticks have been brought together for grasping of a food item or other object.

Referring to the drawings, wherein like reference numerals represent like parts throughout the various drawing figures, reference numeral 10 is directed to a chopsticks assembly (FIG. 1) which allows a pair of chopsticks 20, 30 to be held together, maintained within a common plane without skewing relative to each other, and biasing the chopsticks toward an open orientation, to simplify use of the chopsticks assembly 10. The chopsticks assembly 10 exhibits an exceptionally simple design to minimize complexity of manufacture and cost of materials, and while maintaining biodegradability of materials forming the chopsticks assembly 10. The chopsticks assembly 10 maintains typical handling characteristics to facilitate training in the use of chopsticks (FIGS. 4 and 5).

Figure 1:
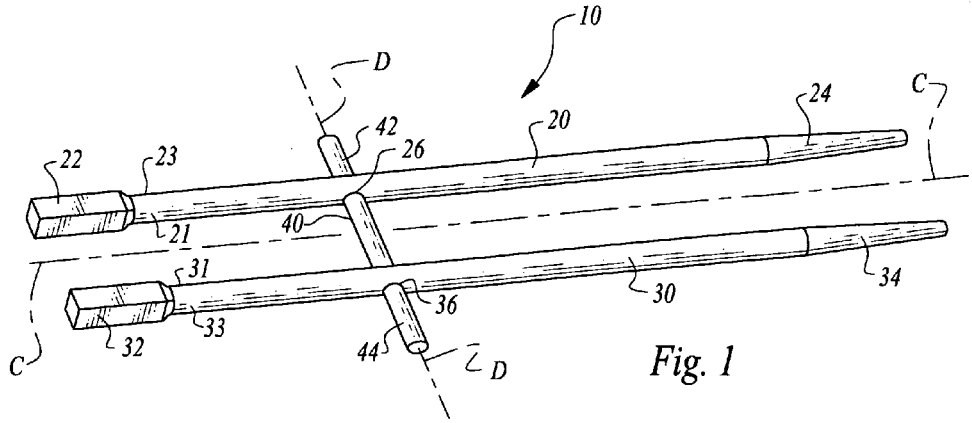
FIG. 1 is a perspective view of the chopsticks of this invention joined together by a pin to form the overall training chopsticks assembly according to a preferred embodiment.
Figure 2:
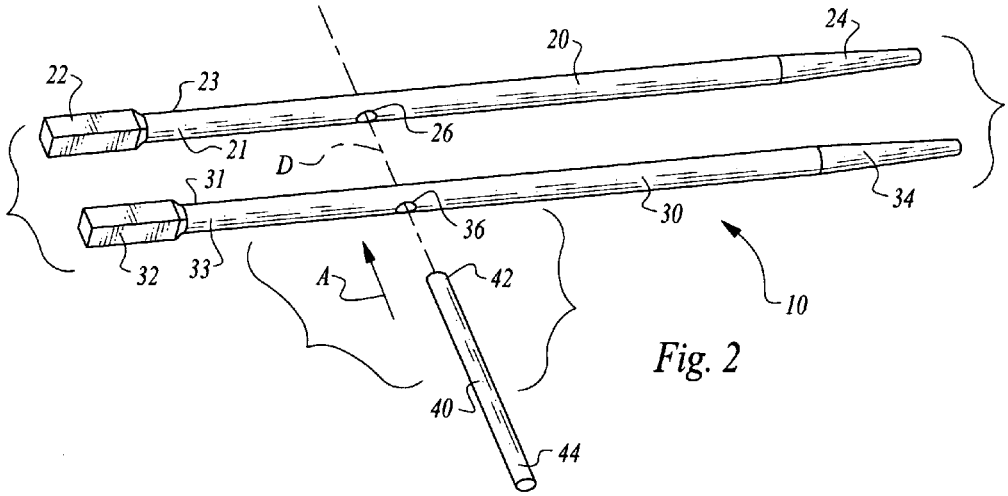
FIG. 2 is a perspective view of that which is shown in FIG. 1 but with the pin exploded away from the chopsticks and illustrating how the pin is aligned with bores in the chopsticks for assembly of the chopsticks and pin together.
Figure 3:
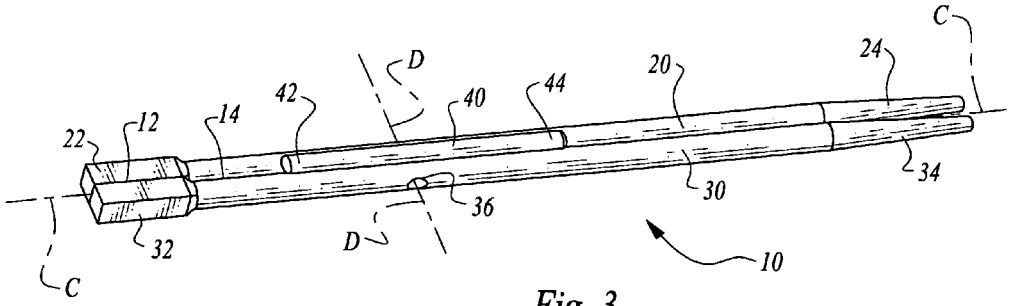
FIG. 3 is a perspective view of the chopsticks of this preferred embodiment in their packaged form and before separation of the two elongate chopsticks from each other and removal of the pin for insertion into the bores in the chopsticks.

In essence, and with particular reference to FIGS. 1-3, basic details of the chopsticks assembly 10 are described, according to an exemplary embodiment depicted in the figures herein. The assembly 10 includes a first stick 20 and a second stick 30 which are preferably substantially identical to each other. These sticks 20, 30 thus have an elongate form extending between proximal ends 22, 32 and distal ends 24, 34. Bores 26, 36 extend transversally through each of the sticks 20, 30.

A pin 40 is provided which is sized to fit into each of the bores 26, 36 in each of the sticks 20, 30. The pin 40 both joins the sticks 20, 30 together and is also capable of flexing somewhat so that the distal end 24, 34 of the sticks 20, 30 can be brought together for use of the chopsticks assembly 10, while tending to provide a return force to return the chopsticks assembly 10 to an original position after the distal ends 24, 34 have been brought together. By forming the bores 26, 36 and the pin 40 having a non-circular cross-section, a resistance to skewing of the sticks 20, 30 relative to each other is provided, so that they remain within substantially common plane and the distal ends 24, 34 reliably come together (rather than missing each other) when forces are applied (along arrow B of FIGS. 4 and 5) to bring the distal ends 24, 34 together.

More specifically, and with continuing reference to FIGS. 1-3, specific details of the sticks 20, 30 within the chopsticks assembly 20 are described, according to this exemplary embodiment. Initially, the chopsticks assembly 10 is preferably a unitary assembly where the sticks 20, 30 can initially be formed together and interconnected at an interface 12 (FIG. 3). This interface 12 is preferably frangible, such as providing a grain of the wood from which the sticks 20, 30 are formed, oriented parallel with this interface 12. A user can thus apply a force separating the sticks 20, 30 from each other and cause the sticks 20, 30 to separate at this interface 12. Alternatively, an adhesive, such as a starch based biodegradable adhesive can be provided between the proximal ends 22, 32 of the sticks 20, 30 to join them at the interface 12.

A slot 14 exists between the two sticks 20, 30 when in this original position (FIG. 3). This slot 14 provides a convenient location for initial positioning of the pin 40. While the pin 40 could also be formed along with the sticks 20, 30 from a single piece of wood, the pin 40 is preferably a separate structure which is preferably attached within this slot 14 with a light strength adhesive, such as a starch adhesive, merely to hold the pin 40 in position until it is desired to snap the pin 40 off of the sticks 20, 30 for use of the pin 40.

Each stick 20, 30 is preferably of similar form. This form is elongate with a longer longitudinal axis than a width between an inner side 21 and an outer side 23 and a height extending perpendicular to the longitudinal axis and a pin axis D passing through each of the sticks 20, 30. Typically, the sticks 20, 30 have a similar height and width, and typically have a square or circular cross-sectional form. The sticks 20, 30 are known in the prior art to have a variety of different cross-sectional forms, lengths, materials from which they are formed, and other distinctive details. These known prior art chopsticks details can be incorporated into the configuration of the sticks 20, 30 of this invention in various different embodiments which are considered to be within the scope of this invention.

Most preferably, the sticks 20, 30 are formed of natural wood, or cellulosic material, such as wood fibers which have been formed to exhibit the shape and size desired, such as depicted in FIGS. 1-3. Typically, the grain of the wood runs substantially parallel to the longitudinal axis of the sticks 20, 30 such that the sticks 20, 30 resist breakage. The second stick 30 has a shape similar to the first stick 20, with the second stick 30 featuring an inner side 31 opposite an outer side 33 and a proximal end 32 opposite a distal end 34. The distal ends 24, 34 typically taper at least slightly. The proximal ends 22, 32 typically are slightly larger than other portions of the sticks 20, 30. An elongate central shaft of each stick 20, 30 is preferably of substantially constant cross-sectional form and typically an elongate cylindrical form. As an alternative, these sticks 20, 30 can very gradually taper from the proximal end 22 to the distal end 24.

Uniquely, each of the sticks 20, 30 includes a bore 26, 36 passing therethrough. These bores 26, 36 are oriented along a line transverse to the longitudinal axis of the sticks 20, 30. This transverse axis is preferably perpendicular to a centerline C between the two sticks 20, 30 and also perpendicular to the longitudinal axis of each stick 20, 30. These bores 26, 36 preferably extend entirely through each of the sticks 20, 30, but could conceivably only extend into the inner sides 21, 31 in the form of blind bores. The bores 26, 36 preferably are sized and shaped so that a pin 40 can pass into the bores 26, 36 and exhibit a friction fit within the bores 26, 36. In this way, such a pin 40 joins the two sticks 20, 30 together.

With continuing reference to FIGS. 1-3 and 6, particular details of the pin 40 for joining the sticks 20, 30 together are described, according to this exemplary embodiment. The pin 40 is preferably an elongate rigid structure, preferably formed of a cellulosic material, and most preferably from natural wood. The pin 40 preferably has a substantially constant cross-sectional form between a first tip 42 and a second tip 44. These tips 42, 44 can be slightly tapered to facilitate their insertion into the bores 26, 36 and the sticks 20, 30. The pin 40 is preferably entirely straight. In an alternative embodiment, it is conceivable that the pin 40 could have some degree of curvature formed therein. The pin 40 extends along a pin axis D aligned with the bores 26, 36 and preferably generally perpendicular to a centerline C of the chopsticks assembly 10. Insertion of the pin 40, along arrow A of FIGS. 2 and 6, positions the pin 40 passing through each of the bores 26, 36 and joining the sticks 20, 30 together.

Figures 6, 7, 8, 9, 10, 11:
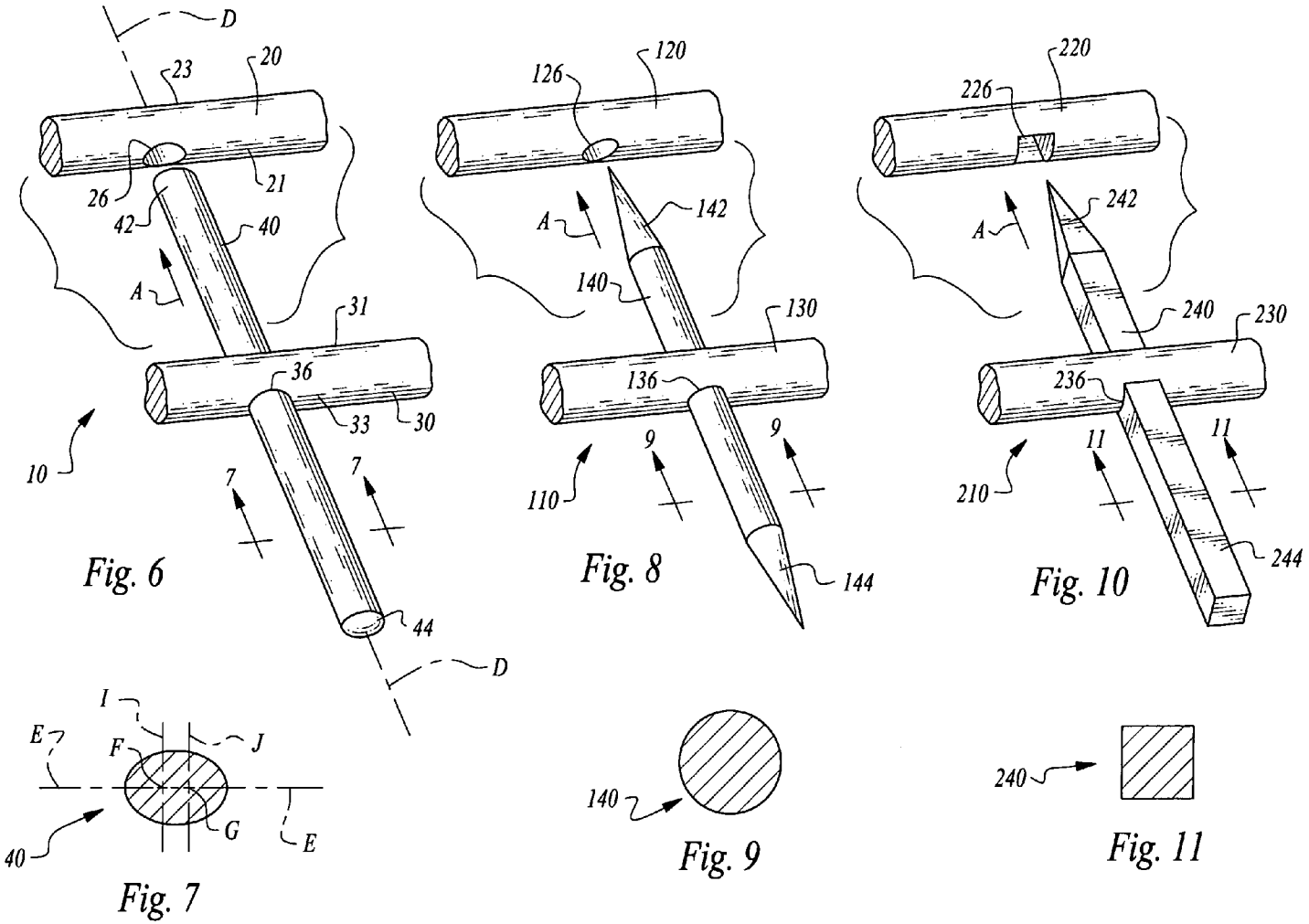
FIG. 6 is a perspective view of a portion of that which is shown in FIG. 1 and illustrating in greater detail configuration of bores within the chopsticks and how the pin is inserted into the bores in the chopsticks.
FIG. 7 is a sectional view taken along lines 7-7 of FIG. 6 and illustrating a cross-section of the pin according to this preferred embodiment.
FIG. 8 is a perspective view of an alternative embodiment of that which is shown in FIG. 6 where the bores have a circular cross-section and the pin has pointed tips.
FIG. 9 is a full sectional view taken along lines 9-9 of FIG. 8 and illustrating a cross-section of the pin in this alternative embodiment.
FIG. 10 is a perspective view similar to that which is shown in FIG. 6, but for an alternative embodiment featuring square bores and a pin having a square cross-section, as well as a single pointed tip.
FIG. 11 is a full sectional view taken along lines 11-11 of FIG. 10 and illustrating a cross-section of the pin in this second alternative embodiment.

Most preferably, the pin 40 has a non-circular cross-section. Furthermore, the bores 26, 36 preferably also have a non-circular cross-section which most preferably has a contour matching the cross-section of the pin 40. In this exemplary embodiment, the cross-section of the pin 40 is provided as an ellipse or other generally oval shape (FIG. 7). The bores 26, 36 preferably have a matching elliptical or oval contour.

With such a contour, the cross-section of the pin 40 exhibits a major diameter along a major axis E which is greater than a minor diameter along a first minor axis I and a second minor axis J. The cross-section of the pin 40 exhibits a pair of foci including a first focus F and a second focus G associated with the elliptical form of the pin 40 in this exemplary embodiment.

Preferably, the major diameter is only greater than the minor diameter by an amount sufficient to resist rotation of the pin 40 and the chopsticks 20, 30 relative to each other. Such a rotation resistant characteristic keeps the two sticks 20, 30 within a common plane including the centerline C and the pin axis D. Otherwise, the sticks 20, 30 can have a tendency to rotate about the pin 40 and become skewed relative to each other. As can be understood, with such rotation, the sticks 20, 30 are no longer within a common plane. When the distal ends 24, 34 of the sticks 20, 30 are then brought together, the potential exists for these ends 24, 34 to not come together, but rather to miss each other. With the non-circular form of the pin 40 and the bores 26, 36, such skewed misalignment is resisted. The pin 40 is shown with its major diameter extending along the major axis E and with the major axis E within the plane including the centerline C and the pin axis D. Such an orientation allows for the bores 26, 36 to be formed in the sticks 20, 30 while leaving significant portions of the sticks 20, 30 remaining to provide strength to the sticks 20, 30. As an alternative, the major axis E could be oriented out of this plane including the centerline C and the pin axis D, and potentially even perpendicular to this plane including the centerline C and the pin axis D.

While the bores 26, 36 preferably have a contour matching that of the cross-section of the pin 40, as an alternative, the bores 26, 36 could merely have a complemental form but not an identical form. For instance, the pin 40 could have a rectangular cross-section while the bores 26, 36 have an oval cross-section with dimensions which accommodate a rectangular pin 40 passing therethrough. Also, due to a relative softness of the materials forming the sticks 20, 30 and the pin 40, it is conceivable that the contours would not entirely match, but that surfaces of the pin 40 and/or the bores 26, 36 would be deformed during the process of inserting the pin 40 into the sticks 20, 30 (along arrow A of FIGS. 2 and 6) so that secure coupling of the pin 40 and sticks 20, 30 would be achieved. Through experimentation, tolerances can be selected, along with wood hardnesses or other material hardnesses to achieve desired performance where the pin 40 can be relatively easily placed within the bores 26, 36 in a relatively consistent and reliable fashion and provide the performance characteristics desired.

In use and operation, after the pin 40 has been passed through the bores 26, 36 of the sticks 20, 30, the chopsticks assembly 10 is ready for use (FIGS. 4 and 5). A user then uses the assembly 10 in a manner similar to regular chopsticks which have not been joined together. The existence of the pin 40 joining the sticks 20, 30 together uniquely keeps the chopsticks 20, 30 within a common plane. Also, the pin 40 bends slightly during the process of bringing the sticks 20, 30 together (along arrow B of FIGS. 4 and 5). The pin 40 bends elastically so that the greater bending existing on the pin 40 the greater a return force is exerted on the sticks 20, 30 tending to return the sticks 20, 30 to their original position. A user thus merely need apply a force tending to bring the distal ends 24, 34 of the sticks 20, 30 toward each other, without requiring the fine motor skills required to keep the sticks 20, 30 within a common plane, and without requiring the exceptional dexterity necessary to control position of the sticks 20, 30 moving towards each other and then back away from each other after use.

Once a user has mastered the use of the sticks 20, 30 with the pin 40 included therewith, and has become comfortable with many of the other aspects of utilizing chopsticks 20, 30, a user can experiment by removing the pin 40 and continuing to use the sticks 20, 30 as standard chopsticks unattached to each other. If the user needs additional training, the pin can be reinserted into the bores 26, 36.

While the exemplary embodiment has been described above with reference to FIGS. 1-7, a variety of modifications can be made to this exemplary embodiment within the scope of this invention. A first alternative chopsticks assembly 110 provides such an alternative embodiment and is depicted in FIGS. 8 and 9. In this embodiment, the chopsticks assembly 110 is formed of a first stick 120 and a second stick 130 which are similar to the sticks 20, 30 of the chopsticks assembly 10 described above (FIGS. 1-7) except that round bores 126, 136 are formed in the sticks 120, 130. Furthermore, a round pin 140 is provided for fitting within the round bores 126, 136. Such a round pin 140 can be desirable in certain instances, such as where it is desirable that a user gain the skill of keeping the sticks 20, 30 within a common plane without assistance.

Conceivably, the chopsticks assembly 10 could be provided with both a round pin 140 and a pin 40 having non-circular cross-section. If the pin is provided of a wood or other material of sufficient hardness that is greater than a material forming the sticks, conceivably the bores can be "tapped" by the pin itself so that bores of a single contour can accommodate pins of different cross-sections. For instance, if the bores have a circular cross-section and two pins are provided, one with a square cross-section and one with a round cross-section, the round cross-section pin can be selected for an intermediate skill user and the square cross-section pin can be utilized for a novice. The square cross-section pin formed of a harder material than that forming the sticks could be pressed into bores having a circular cross-section with corners of the square cross-section pin digging into walls of the bore sufficiently to keep the sticks from rotating relative to each other and remaining within a common plane.

In this first alternative chopsticks assembly 110, the round pin 140 is depicted with a pointed first tip 142 and a pointed second tip 144. Thus, the round pin 140 is generally in the form of a standard toothpick. The pointed tip can have a greater or lesser degree of sharpness as is known in the toothpick arts. Also, conceivably only a single one of the two tips 142, 144 could be provided with this sharpened tip. As another alternative, the two tips 142, 144 could exhibit differing degrees of pointedness to fit within different size gaps between teeth. In this embodiment, when a meal has been enjoyed and a user desires to utilize the toothpick, the pin 140 is removed from the sticks 120, 130 and then utilized as a toothpick.

A second alternative chopsticks assembly 210 is illustrated in FIGS. 10 and 11. In this second alternative chopsticks assembly 210, a first stick 220 and second stick 230 are provided which each exhibit a square bore 226, 236. A square pin 240 is provided with a square cross-section (FIG. 11). In this embodiment, the square pin 240 is illustrated with a pointed tip 242 and a non-pointed tip 244 to illustrate how the pin 240 can have a variety of different pointed or non-pointed tip configurations. The pointed tip 242 also facilitates easier passage of the pin 240 through the bores 226, 236.

While the bores 226, 236 and the square pin 240 are shown with sharp corners, it is conceivable that these corners would be somewhat rounded, not only to facilitate the forming process, but also to avoid any splintering tendency. While the square pin 240 illustrates one form of faceted pin contour, other faceted pin contours could also be utilized, such as a triangular cross-section, a pentagonal cross-section, a hexagonal cross-section, or other polygonal cross-sections which are either regular in form or irregular in form. Also, interior and exterior angles can be combined together, such as with a star contour of multiple different points. The bores 226, 236 can be provided with a matching contour or merely a complemental contour so that the pin can fit within the bores and relative rotation therebetween is resisted.

This disclosure is provided to reveal a preferred embodiment of the invention and a best mode for practicing the invention. Having thus described the invention in this way, it should be apparent that various different modifications can be made to the preferred embodiment without departing from the scope and spirit of this invention disclosure. When structures are identified as a means to perform a function, the identification is intended to include all structures which can perform the function specified. When structures of this invention are identified as being coupled together, such language should be interpreted broadly to include the structures being coupled directly together or coupled together through intervening structures. Such coupling could be permanent or temporary and either in a rigid fashion or in a fashion which allows pivoting, sliding or other relative motion while still providing some form of attachment, unless specifically restricted.

What is claimed is:

1. A pair of chopsticks featuring ease of use, the chopsticks comprising in combination:

a first elongate chopstick extending from a proximal end to a distal end;

a second elongate chopstick extending from a proximal end to a distal end;

said first chopstick having a first bore extending at least into said first chopstick at a location between said proximal end and said distal end and along a line transverse to a longitudinal axis extending between said proximal end and said distal end;

said second chopstick having a second bore extending at least into said second chopstick at a location between said proximal end and said distal end and along a line transverse to a longitudinal axis extending between said proximal end and said distal end;

an elongate pin, said pin having a first tip sized to fit within said first bore and a second tip sized to fit within said second bore, said pin located extending at least into both said first bore and said second bore;

wherein said pin is adapted to flex about an axis perpendicular to a longitudinal axis of said pin and substantially perpendicular to longitudinal axes of said first chopstick and said second chopstick; and wherein said chopsticks and said pin are each formed of a cellulosic material.

2. The chopsticks of claim 1 wherein at least one of said first bore and said second bore extends entirely through at least one of said chopsticks.

3. The chopsticks of claim 2 wherein said elongate pin extends through at least one of said bores.

4. The chopsticks of claim 1 wherein said pin is non-circular in cross-section.

5. The chopsticks of claim 1 wherein said pin includes at least one tip that is at least somewhat pointed.

6. The chopsticks of claim 1 wherein said chopsticks and said pin are each formed of shaped wood.

7. A pair of chopsticks featuring ease of use, the chopsticks comprising in combination:

a first elongate chopstick extending from a proximal end to a distal end;

a second elongate chopstick extending from a proximal end to a distal end;

said first chopstick having a first bore extending at least into said first chopstick at a location between said proximal end and said distal end and along a line transverse to a longitudinal axis extending between said proximal end and said distal end;

said second chopstick having a second bore extending at least into said second chopstick at a location between said proximal end and said distal end and along a line transverse to a longitudinal axis extending between said proximal end and said distal end;

an elongate pin, said pin having a first tip sized to fit within said first bore and a second tip sized to fit within said second bore, said pin located extending at least into both said first bore and said second bore;

wherein said pin is adapted to flex about an axis perpendicular to a longitudinal axis of said pin and substantially perpendicular to longitudinal axes of said first chopstick and said second chopstick;

wherein said pin is non-circular in cross-section; and wherein said pin and said bores each have an at least somewhat square cross-section.

8. A pair of chopsticks featuring ease of use, the chopsticks comprising in combination:

a first elongate chopstick extending from a proximal end to a distal end;

a second elongate chopstick extending from a proximal end to a distal end;

said first chopstick having a first bore extending at least into said first chopstick at a location between said proximal end and said distal end and along a line transverse to a longitudinal axis extending between said proximal end and said distal end;

said second chopstick having a second bore extending at least into said second chopstick at a location between said proximal end and said distal end and along a line transverse to a longitudinal axis extending between said proximal end and said distal end;

an elongate pin, said pin having a first tip sized to fit within said first bore and a second tip sized to fit within said second bore, said pin located extending at least into both said first bore and said second bore;

wherein said pin is adapted to flex about an axis perpendicular to a longitudinal axis of said pin and substantially perpendicular to longitudinal axes of said first chopstick and said second chopstick;

wherein said pin is non-circular in cross-section; and wherein said pin and said bores each have an elliptical cross-section.

9. The chopsticks of claim 8 wherein each of said bores has a major diameter and a minor diameter, with said major diameter longer than said minor diameter, said major diameter oriented substantially parallel with said longitudinal axis of said first chopstick and said longitudinal axis of said second chopstick.

10. A pair of chopsticks featuring ease of use, the chopsticks comprising in combination:

a first elongate chopstick extending from a proximal end to a distal end;

a second elongate chopstick extending from a proximal end to a distal end;

said first chopstick having a first bore extending at least into said first chopstick at a location between said proximal end and said distal end and along a line transverse to a longitudinal axis extending between said proximal end and said distal end;

said second chopstick having a second bore extending at least into said second chopstick at a location between said proximal end and said distal end and along a line transverse to a longitudinal axis extending between said proximal end and said distal end;

an elongate pin, said pin having a first tip sized to fit within said first bore and a second tip sized to fit within said second bore, said pin located extending at least into both said first bore and said second bore;

wherein said chopsticks and said pin are each formed of a cellulosic material;

wherein said chopsticks and said pin are each formed of shaped wood; and wherein said pin is formed of a wood that is different from a wood forming said chopsticks, said wood forming said pin being harder than said wood forming said chopsticks.

11. The chopsticks of claim 10 wherein said pin is formed of bamboo.

* * * * *